United States Patent [19]

Graves et al.

[11] Patent Number: 4,786,192

[45] Date of Patent: Nov. 22, 1988

[54] DEVICE FACILITATING FILLING AND UNFOLDING OF BAG WITHIN OUTER CASING

[75] Inventors: Stewart M. Graves, Priddbwbll Bonc; Peter J. M. Stuart, Wollaston; Adrian P. Peet, Bredbury; Peter M. Maple, Worsley, all of United Kingdom

[73] Assignee: Sonoco Limited, Stockport, England

[21] Appl. No.: 161,134

[22] Filed: Feb. 26, 1988

[51] Int. Cl.[4] ..... B65D 33/02

[52] U.S. Cl. ..... 383/119; 383/109; 383/904; 220/403; 220/462

[58] Field of Search ..... 383/119, 3, 4, 106, 383/109, 904, 906; 220/403, 407, 462

[56] References Cited

U.S. PATENT DOCUMENTS

| | | | |
|---|---|---|---|
| 3,137,433 | 6/1964 | Lipschutz et al. | 220/462 |
| 3,206,094 | 9/1965 | Humphrey et al. | 220/462 |
| 3,208,658 | 9/1965 | Membrino | 220/462 |
| 3,249,286 | 5/1966 | Palmer | 383/119 |
| 3,272,423 | 9/1966 | Bjarno | 383/119 |
| 3,399,818 | 9/1968 | Stegner | 383/119 |
| 3,957,195 | 5/1976 | Lin | 220/462 |
| 4,622,693 | 11/1986 | Mykleby | 383/119 |

*Primary Examiner*—Willis Little

*Attorney, Agent, or Firm*—Dennison, Meserole, Pollack & Scheiner

[57] ABSTRACT

A cartridge is provided in the form of a sheet of material having swingable flaps extending from opposing side regions. A folded bag, which is to be filled with fluid, is positioned on the sheet and attached to the flaps, and the flaps are folded thereover in the initial position. In use, the cartridge is placed in a casing and, upon filling, the bag expands in a controlled manner and pushes back the flaps.

5 Claims, 1 Drawing Sheet

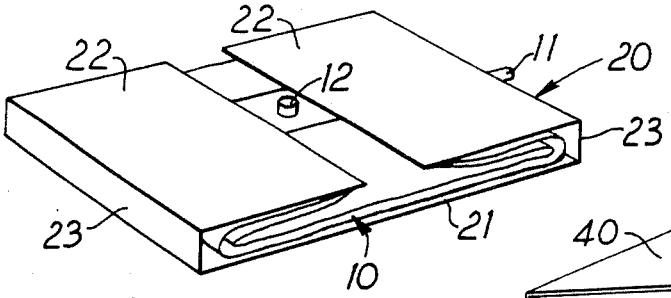
Fig. 1
Fig. 6
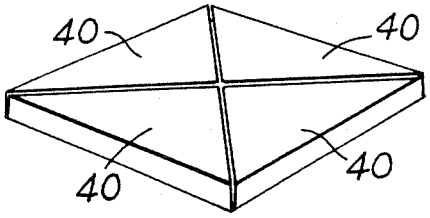
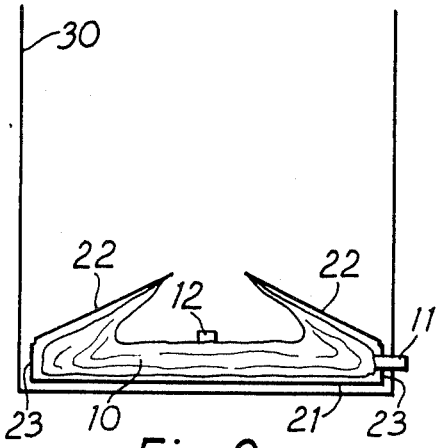
Fig. 2
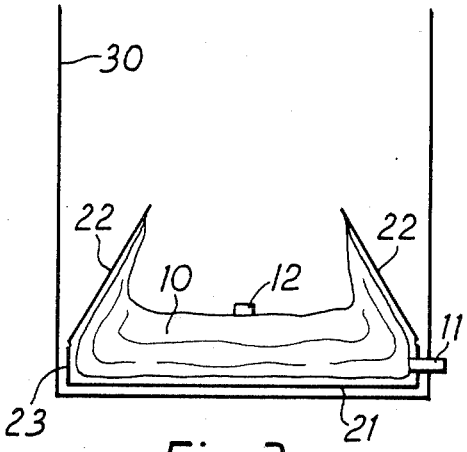
Fig. 3
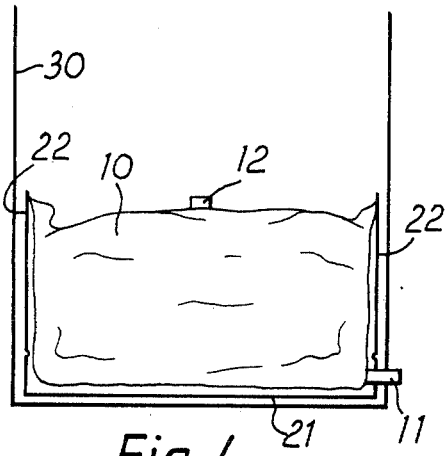
Fig. 4
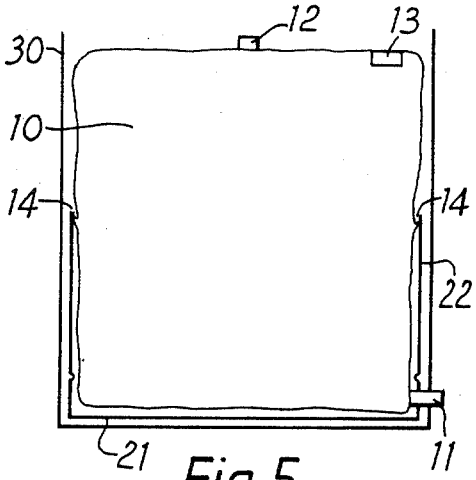
Fig. 5

DEVICE FACILITATING FILLING AND UNFOLDING OF BAG WITHIN OUTER CASING

TECHNICAL FIELD

This invention relates, in general, to a bulk container comprising a collapsible bag disposed inside a substantially rigid casing, and more specifically to a device facilitating filling and unfolding of the bag when located within the casing.

BACKGROUND ART

For the storage and transportation of fluid substances in bulk, containers in the form of a bag of flexible material disposed inside an outer casing of rigid or semi-rigid material are becoming increasingly popular. They have the advantage that the cleanliness or sterility of the inner bag, which receives the fluid substance, can be assured. Moreover, the material of the bag can form a reliable oxygen-impermeable barrier, which is important to prevent spoilage of food and other substances. Neither of the foregoing requirements could be so reliably achieved with previously used rigid drums, even where these were lined. With the new so-called "bag-in-box" type containers, of course, the bag can be disposed of and replaced after each trip so that problems of cleaning and possible contamination of the container interior do not arise.

Nowadays, products such as UHT milk, which require aseptic containers, are transported in the aforesaid type of bag-in-box container. Other products which require extremely hygenic and/or oxygen impermeable containers, such as fruit juices, tomato paste and juice, cosmetic ingredients, glues and resins, are also transported in this sort of container. It will be appreciated that such a container is suitable for pastes, powders and other granular material as well as liquids, all the foregoing being encompassed by the 'fluid'.

The outer casing of such a container is generally made of metal and/or wood and/or corrugated board or other substantially rigid material and it may, for example, be about 1 m×1 m×1 m. This casing is used and re-used for transporting substances, often over very long distances and overseas. In contrast, the inner bag is generally made of multiple layers of sheet plastics, sometimes laminated or co-extruded with metalized foil, the layers being bonded, e.g. heat welded, together around their peripheral margins. As mentioned above, the bag is probably used only once and discarded.

The bag is not usually connected to the outer casing in any permanent, or even semi-permanent manner since it is designed to be placed into a casing, to unfold and expand in volume when filled with fluid so as to fill the interior of the casing, and subsequently to collapse again upon emptying so that it can thereafter be readily removed from the casing. The bag will either have a single inlet/outlet port through which it is filled and emptied, or two separate ports, namely an inlet port for filling and an outlet port for emptying. Moreover, in many cases the bag will also have a specially designated area or patch through which samples of fluid contained therein can be extracted by syringe, for example during customs inspections.

It is obviously important that the inlet/outlet port or respective ports and the aforesaid patch are correctly aligned with apertures in the outer casing so that access thereto is possible from the exterior of the container. In the case of an inlet port or a combined inlet/outlet port this is usually achieved simply by locating a member which defines the port in the appropriate aperture in the casing as the bag is placed in the casing. However, in the case of a separate outlet port and of a patch for sampling purposes it is necessary to carefully control the filling of the bag to try and bring the port and the patch to approximately the desired final location relative to the outer casing in which the bag is disposed. Careful control of the filling of the bag is also extremely important for another reason, namely to ensure that it unfolds and expands fully (i.e. without corners or lobes becoming trapped or compressed or air-filled) so as to accommodate the desired maximum quantity of fluid (e.g. 1 tonne) and prevent bag damage from distortion. It will thus be appreciated that the operation of filling the bag with the fluid to be stored and transported is absolutely critical to satisfactory use of this type of container.

Hitherto, the unfolding and expansion of the bag during the filling operation have required constant manual supervision and adjustment. This is time-consuming and greatly increases labour costs. Moreover if the supervisor is not skilled or is not vigilant, bag filling may still not be accomplished in a satisfactory manner.

It is an object of the present invention to provide a device which, in a bag-in-box container of the above-described type, will facilitate satisfactory unfolding and expansion of the bag during the filling operation so as to obviate the need for constant manual supervision.

SUMMARY OF INVENTION

With this object in view, the present invention provides a device comprising a cartridge in the form of a sheet of material provided with flaps extending from opposing side regions thereof, which flaps are swingable outwardly from a folded position overlying the sheet, and a bag, which is initially folded, positioned upon the sheet and attached at certain locations to the flaps and which is designed to unfold and expand and thereby push back the flaps upon reception of fluid through an inlet port.

In use, the device will obviously be placed in the base of an outer casing which is to support the bag when the latter is filled with fluid. The basal sheet of the cartridge is, therefore, preferably so dimensioned as to fit snugly into the base of such casing.

The free edges of the flaps may or may not overlap each other when they overlie the basal sheet. In cases where the bag is to be filled from the top, it will probably be best, from a practical point of view, if the flaps do not overlap so as to enable easy access to the inlet port of the bag at the start of the filling operation. In contrast, where the bag is to be filled from, the bottom, the inlet port will conveniently project through the cartridge and locate in an aperture in the casing.

Whilst a single pair of opposing flaps will function adequately, in further embodiments of the invention two pairs of flaps may be provided on the cartridge, and these may be arranged as side-by-side pairs or with the four flaps arranged mutually at right angles to each other.

Advantageously, locations on the seam of the bag are attached adjacent the free edges of the flaps. With this arrangement, the seams of the bag can be caused to rise to a uniform position approximately half way up the outer casing as the bag fills and this tends to more reliably ensure unfolding and expansion of the bag.

BRIEF DESCRIPTION OF DRAWINGS

The invention will be described further, by way of example, with reference to the accompanying drawings, in which:

FIG. 1 is a diagrammatic perspective view of a first embodiment of a device in accordance with the invention;

FIGS. 2 to 5 are diagrammatic side views illustrating successive stages in the filling of the bag when the device shown in FIG. 1 is disposed in an outer casing, the front wall of the casing being omitted for the sake of clarity; and FIG. 6 is a diagrammatic perspective view of a second embodiment of a device in accordance with the invention.

DETAILED DESCRIPTION OF ILLUSTRATED EMBODIMENTS

Referring firstly to FIG. 1, a first embodiment of the device of the invention comprises a bag 10 of flexible plastics material located within a cartridge 20 made of cardboard, preferably corrugated cardboard. The cartridge 20 consists of a substantially square basal sheet 21 with respective rectangular flaps 22 connected thereto, along opposing side edges, by way of connecting strips 23. Fold lines are present between the basal sheet 21 and the strips 23 and between the strips 23 and their respective flaps 22 and, in the initial, folded condition of the cartridge, the strips 23 extend generally perpendicular to the basal sheet 21, whilst the flaps 22 extend towards each other generally parallel to the basal sheet 21 and thus overlie said sheet 21. The free edges of the flaps 22 do not overlap and a gap remains therebetween.

The bag 10 is located between the basal sheet 21 and the overlying flaps 22. When produced, the bag 10 is in form of a large flat rectangle, with its various constituent layers bonded together at a seam 14 around the periphery of the rectangle. When incorporated into the device shown in FIG. 1, the bag 10 is folded and various points around its seam 14 are secured to the respective flaps 22, adjacent their free edges. The manner of folding of the bag 10 and the manner of attachment of the seam to the flaps 22 are not illustrated in any detail, since there are numerous possibilities. The bag 10 is capable of holding 1000 liters of liquid, such as milk or fruit juice.

In this particular embodiment, the bag 10 is provided with an outlet port 11 and a separate inlet port 12 as well as with a patch 13 for extraction of samples. The outlet port 11 is intended to remain at the bottom of the bag 10 when the latter is filled with fluid and its position is therefore fixed by it being inserted through a central aperture in one of the connecting strips 23 of the cartridge, as indicated in FIGS. 2 to 5. The inlet port 12 is intended to be at the top of the bag 10 when the latter is filled with fluid and, at the outset, when the bag 10 is positioned in the cartridge 20, it projects into the gap between the edges of the flaps 22. The patch 13 is in the vicinity of the inlet port 12. Both the inlet port 12 and the patch 13 are intended, in the final transportable package, to be aligned with apertures or windows (not shown) in a supportive outer casing 30 (see FIGS. 2 to 5) into which the device is placed before the bag 10 is filled with fluid.

In use, the device is placed inside a metallised casing 30 which is approximately 1 cu m in size. In this respect, the basal sheet 21 of the cartridge 20 is of an appropriate size, i.e. just less than 1 sq. m, so as to fit snugly into the base of the casing 30. The lid of the casing 30 is removed throughout the bag filling procedure and in some cases the device may simply be placed into the casing 30 from the top. More commonly, however, one side wall of the casing 30 is temporarily removed and the device is slid into position through the resultant opening. With the latter method of placement of the device into the casing, the outlet port 11 can more easily be located in an aperture near the base of the casing 30, as indicated in FIGS. 2 to 5. If a side wall of the casing 30 is removed it is replaced prior to bag filling.

A fluid supply pipeline is then attached to the inlet port 12 and fluid, probably a liquid such as milk or fruit juice, is supplied to the interior of the bag 10. As the bag 10 fills, it gradually unfolds and pushes back the flaps 22, as shown in the sequence from FIGS. 2 to FIG. 4. When the bag 10 is almost half full, as shown in FIG. 4, the flaps 22 are pressed firmly against the walls of the casing 30 by the pressure of the liquid. In this respect, the free edges of the flaps 22 and the seams 14 of the bag 10 attached adjacent thereto now lie approximately half way up the height of the casing walls. As filling continues, further unfolding and expansion of the bag 10 ensues until the maximum quantity of liquid is accommodated and the bag takes up the entire interior of the casing, as shown in FIG. 5.

The swinging back of the flaps 22 with the bag seams 14 attached thereto minimises the likelihood of irregular unfolding of the bag 10 which may lead to hitherto unfilled sections or corners of the bag 10 being trapped by the pressure of liquid and hence unable to receive liquid. In this respect, the extension of the flaps 22 to about half way up the wall height of the casing and the attachment of the seams 14 adjacent the edges of the flaps 22 is particularly favourable.

The controlled expansion of the bag 10 brought about by its location in and attachment to the cartridge 20 also facilitates correct positioning of the inlet port 12 and the patch 13 in the fully expanded bag 10. In this respect, when the lid (not shown) of the casing 30 is fixed onto the top of the casing 30, apertures or windows will overlie the inlet port 12 and the patch 13 in the positions they have assumed in FIG. 5.

Once the bag 10 is filled, the inlet port 12 closed off and the casing lid secured, the resulting bulk container is ready for transportation. It is later emptied at its destination by way of the outlet port 11. The bag 10 can then be discarded, the cartridge 20 may be reused or discarded and the outer casing 30, in this instance, will probably be re-used.

The great importance of the device of the invention is that it does away with the need for constant manual supervision during the filling of such bulk containers and it should, eventually, enable complete automation of the filling procedure which will increase speed and greatly reduce costs. A further advantage is that the material of the cartridge lies between the bag and the base of the casing interior and this may protect the bag from tearing or contamination in the event that grit or dirt or the like is present in the casing. This reduces the need for care in sweeping out and/or cleaning the casing.

Of course, the invention is not restricted to the details of the foregoing exemplary embodiment and many variations are possible, for example as regards the materials, the size and the capacity of the bag and the outer casing. In relation to the bag, separate inlet and outlet ports may not be provided and both filling and emptying may be accomplished through a common port (equivalent to port 11 in the example) at the bottom of the bag (relative to its position in the casing). In relation to the casing, the material of which it is constructed will determine whether it is a so-called 'one-trip' casing to be discarded, or a 'multi-trip' casing to be re-used several times. Turning to the cartridge, this may be made from any other appropriate preferably inexpensive and relatively hardwearing material, instead of the cardboard referred to in the example. Also, provision of connection strips between the flaps and the basal sheet of the cartridge is not necessary and the flaps may be of different shape. The cartridge may also have more than two flaps, for example as indicated in FIG. 6 wherein four tapered or pointed flaps 40 are mutually at right angles to each other, and, when folded, meet almost over the centre of the basal sheet.

It was mentioned in the foregoing that numerous sequences or arrangements of bag folding are possible, and this is certainly so. However, it has been found that a particularly good way of folding the bag is to take hold of the four corners of the bag (when laid out as a flat rectangle or square) and move each of these corners to the centre, thus producing when rotated through 45°, a smaller rectangular pack. The process is then repeated a second time before the folded bag is placed in the cartridge. The points of the bag then positioned at the centre are then attached to the cartridge flaps, preferably one to each of four flaps as in the FIG. 6 embodiment. This has the particular advantage of ensuring that the finally filled bag has its free corners loose on the top and not distorting the bag during filling.

We claim:

1. A device comprising a cartridge in the form of a sheet of material having opposing side regions and provided with flaps extending from said opposing side regions thereof, said flaps being swingable outwardly from a folded position overlying said sheet, and a bag having means defining an inlet port, said bag being folded, positioned upon said sheet and attached at certain locations to said flaps and being designed to unfold and expand and thereby push back said flaps upon reception of fluid through said inlet port.

2. A device as set forth in claim 1 wherein said inlet port of said bag projects through said cartridge.

3. A device as set forth in claim 1 wherein said cartridge has a single pair of opposing flaps.

4. A device set forth in claim 1 wherein said cartridge has two pairs of opposing flaps, these pairs of flaps being arranged mutually at right angles to each other.

5. A device as set forth in claim 1 wherein said bag is formed with a seam and locations on said seam are attached adjacent free edges of said flaps.

* * * * *